US005317113A

United States Patent [19]

Duda

[11] Patent Number: 5,317,113

[45] Date of Patent: May 31, 1994

[54] ANECHOIC STRUCTURAL ELEMENTS AND CHAMBER

[75] Inventor: John Duda, Dumont, N.J.

[73] Assignee: Industrial Acoustics Company, Inc., Bronx, N.Y.

[21] Appl. No.: 907,187

[22] Filed: Jul. 1, 1992

[51] Int. Cl.[5] ..... E04B 1/00

[52] U.S. Cl. ..... 181/285; 181/286; 181/293; 181/294; 181/295

[58] Field of Search ..... 181/284, 285, 286, 290, 181/291, 292, 293, 294, 295, 30

[56] References Cited

U.S. PATENT DOCUMENTS

| | | | |
|---|---|---|---|
| 2,192,516 | 3/1940 | Cunnington | 181/290 |
| 2,706,530 | 4/1955 | Abrams | 181/295 |
| 2,759,554 | 8/1956 | Baruch | 181/295 |
| 2,882,990 | 4/1959 | Mustoe | 181/295 |
| 2,897,908 | 8/1959 | Barshefsky | 181/295 |
| 2,902,854 | 9/1959 | Greene | 181/290 |
| 2,980,198 | 4/1961 | Eckel | 181/290 |
| 3,086,325 | 4/1963 | Eckel | 181/290 |
| 3,421,273 | 1/1969 | Eckel | 181/290 |
| 3,509,964 | 5/1970 | Eckel | 181/290 |
| 3,712,413 | 1/1973 | Eckel | 181/295 X |
| 3,735,837 | 5/1973 | Duda et al. | 181/295 |
| 3,819,010 | 6/1974 | Adams et al. | 181/295 |
| 3,857,459 | 12/1974 | Adams et al. | 181/295 |
| 4,387,786 | 6/1983 | Klipsch et al. | 181/295 X |
| 4,477,505 | 10/1984 | Warnaka | 181/284 X |
| 4,531,609 | 7/1985 | Wolf et al. | 181/290 |
| 4,971,850 | 11/1990 | Kuan-Hong | 181/290 X |

OTHER PUBLICATIONS

Industrial Acoustics Company, "Anechoic Chambers", 1976.

*Primary Examiner*—Michael L. Gellner
*Assistant Examiner*—Khanh Dang
*Attorney, Agent, or Firm*—Morgan & Finnegan

[57] ABSTRACT

A substantially enclosed sound absorbing unit for an anechoic chamber is disclosed. The sound absorbing unit includes a substantially flat panel member comprising a layer of sound absorptive material. An anechoic member is disposed adjacent to the flat panel member. The anechoic member is disposed adjacent to a base and a generally spaced apart sound transparent wall member. The wall member includes a layer of sound absorptive material and a cover sheet made of perforated, substantially sound reflective material. The free space of the perforated cover sheet is at least 7 percent of the total area of the cover sheet.

23 Claims, 5 Drawing Sheets

ANECHOIC STRUCTURAL ELEMENTS AND CHAMBER

FIELD OF THE INVENTION

This invention relates to anechoic chambers and more specifically to new anechoic wedges and structural elements for constructing such chambers.

BACKGROUND OF THE INVENTION

An anechoic chamber is a room in which acoustically free field conditions exist. For practical measurements, it must also be clear of extraneous noise interferences. An environment meeting these conditions is a requirement for precision acoustical measurements. Anechoic chambers are widely used in the development of quieter products in many industries and institutions including the following: aircraft, electrical, transportation, communications, business machines, medical research and universities.

An acoustical free field exists in a homogenous, isotropic medium which is free from reflecting boundaries. In an ideal free field environment, the inverse square law would function perfectly. This means that the sound pressure level ($L_p$) generated by a spherically radiating sound source decreases six decibels (6 dB) for each doubling of the distance from the source. A room or enclosure designed and constructed to provide such an environment is called an anechoic chamber.

An anechoic chamber usually must also provide an environment with controlled sound pressure level ($L_p$) free from excessive variations in temperature, pressure and humidity. Outdoors, local variations in these conditions, as well as wind and reflections from the ground, can significantly and unpredictably disturb the uniform radiation of sound waves. This means that a true acoustical free field is only likely to be encountered inside an anechoic chamber.

For an ideal free field to exist with perfect inverse square law characteristics, the boundaries must have a sound absorption coefficient of unity at all angles of incidence.

Conventionally, an anechoic element is defined as one which should not have less than a 0.99 normal incidence sound absorption coefficient throughout the frequency range of interest. In such a case, the lowest frequency in a continuous decreasing frequency sweep at which the sound absorption coefficient is 0.99 at normal incidence is defined as the cut-off frequency. Thus, in an anechoic chamber, 99% of the sound energy at or above the cut-off frequency is absorbed. For less than ideal conditions, different absorption coefficients may be established to define a cut-off frequency.

As mentioned above, another characteristic of a true free field is that sound behaves in accordance with the inverse square law. In the past, testing wedges in an impedance tube has been a means for qualifying wedges used in chambers simulating free field conditions. A fully anechoic room can also be defined as one whose deviations fall within a maximum of about 1-1.5 dB from the inverse square law characteristics, depending on frequency. Semi-anechoic rooms, i.e., rooms with anechoic walls and ceilings which are erected on existing acoustically reflective floors such as concrete, asphalt, steel or other surfaces, can deviate from the inverse square law by a maximum of about 3 dB depending on frequency.

The table below reflects the maximum allowable differences between the measured and theoretical levels for fully anechoic and semi-anechoic rooms:

| Maximum Allowable Differences Between the Measured and Theoretical Levels | | |
|---|---|---|
| Type of Test Room | One-Third Octave Band Centre Frequency Hz | Allowable Differences dB |
| Anechoic | <630 | ±1.5 |
| | 800 to 5,000 | ±1.0 |
| | >6,300 | ±1.5 |
| Semi-anechoic | <630 | ±2.5 |
| | 800 to 6,000 | ±2.0 |
| | >6,300 | ±3.0 |

Because of the very high degree of sound absorption required in an anechoic chamber, conventional anechoic elements typically comprise fully exposed sound absorptive material or sound absorptive fill elements which are covered with a wire cage to contain and somewhat protect the sound absorbing material. Typical wire mesh coverings have approximately 90-95% open space to allow maximum exposure of sound absorbing material to the sound waves, yet providing a certain level of protection for the material.

A disadvantage with anechoic construction elements as explained above is that in highly industrial environments the wire mesh structure may not provide sufficient physical protection for the elements. The sound absorbing material can therefore become easily disfigured by unintentional impact that is quite foreseeable in a heavily industrial environment.

Another disadvantage of the conventional anechoic elements is potential medical hazards. The sound absorptive materials such as fiberglass, rockwool or foams can be highly erosive. Over a period of use such materials could erode into particulate matter floating in the air which could be inhaled into lungs.

A further disadvantage of the conventional anechoic elements and their wire mesh coverings is that in highly industrial applications, oil spills and dirt may rapidly accumulate on the sound absorbing materials. This may impede sound absorption performance of the material and additionally may impose a fire hazard. Cleaning the sound absorptive material is difficult and not efficient.

Therefore there is a need for an anechoic element which provides a very high degree of sound absorption capabilities and sufficient protection for the sound absorbing material.

SUMMARY OF THE INVENTION

Accordingly, it is an object of the present invention to provide an anechoic element having a desired acoustical performance and yet which is fully encapsulated inside a metallic, or other strong perforated protective casing made of plastic or wood.

It is a further object of the present invention to provide an anechoic element which is impact resistant.

It is still a further object of the present invention to provide an anechoic element which minimizes the possibility of the spread of erosive fiberglass or other absorptive materials into the air.

It is still a further object of the present invention to provide an anechoic element which can be readily cleaned and repainted in the event of oil spills or other accumulations of dirt deposits.

A further object of the present invention is to provide an anechoic element which is highly fire retardant.

A still further object of the present invention is to provide an anechoic element which can be readily produced and interchanged and can be easily adjusted or tuned.

It is another object of the present invention to provide an anechoic element which uses less sound absorptive materials than a conventional element so as to be more economical to manufacture.

The anechoic device according to the present invention includes a substantially flat panel made of a sound absorptive material. A second panel is disposed adjacent to the first panel. In a preferred embodiment of the invention, there is an airspace between the two panels. The second panel may include a plurality of anechoic wedge elements. Each wedge is preferably substantially triangular in cross-section having a base and a pair of inclined wall members. Each wall member includes a layer of sound absorptive material and a cover sheet. The cover sheet is formed from a protective material and while perforated, has a low open area. Preferably, the cover sheet is a perforated metal sheet such as steel. The cover sheet, however, may be made from other rigid materials having low sound absorption characteristics such as wood or plaster. The base may also comprise a perforated sheet of substantially sound reflective material. The open area of each perforated sheet may be as low as about 7% of the total area of the sheet. In a preferred embodiment the cover sheets have an open area of about 23% having perforations 3/32" in diameter on 3/16" centers. The open area ratio may vary as a function of the required physical and acoustical performance. Typically, the perforations may be circular, rectangular, triangular or any other obtained shapes.

In one embodiment of the invention, the wedge is substantially hollow and includes a layer of sound absorptive material on its base, providing an airspace between the sound absorptive material on the base and that of the wedge wall members. In another embodiment of the invention, the entire interior space of the wedge is filled with sound absorbing material.

In accordance with other embodiments of the invention, the second panel, instead of including wedge elements, may include elements which are semi-circular, arcuate or exponentially tapering in cross-section or corrugated.

It should be noted that in all of the above embodiments, the existence of an airspace is not critical to adequate performance of the subject anechoic elements. The airspaces, however, do provide the designer with a mechanism to easily fine tune the performance. For instance, the depth of the airspace has influence on the cut-off frequency of the device. For example, it has been found that, as a general rule, the greater the airspace the lower the cutoff frequency of the device. Other means for affecting the cut-off frequency include the thickness and density of the acoustic fill material.

DETAILED DESCRIPTION OF THE DRAWINGS

Figure 1:
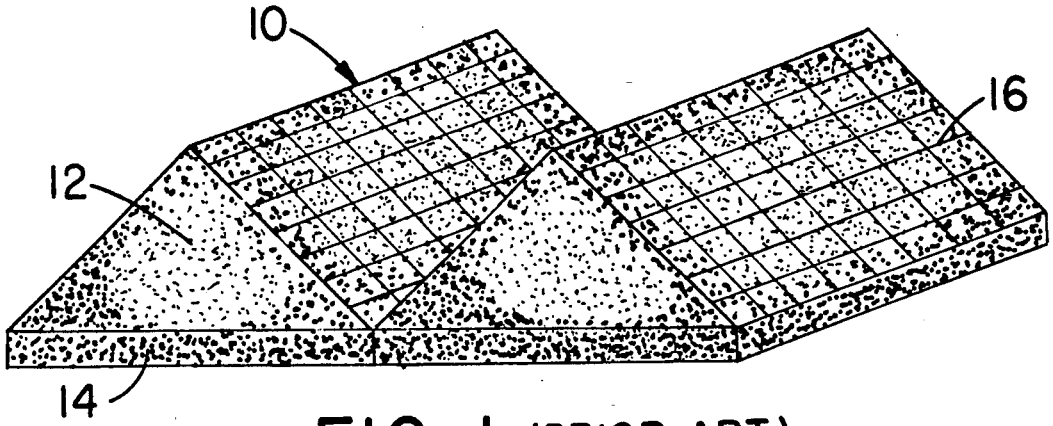
FIG. 1 (PRIOR ART)
FIG. 1 illustrates a cross-section of a conventional anechoic wedge of the prior art.

FIG. 1 illustrates a conventional anechoic wedge 10. As shown, a sound absorbing layer 14 is first mounted next to the anechoic chamber surface such as the walls and the ceiling of the room. Thereafter a series of anechoic wedges are disposed directly onto the sound absorbing layer. Each wedge 10 is made from a sound absorbing material 12. Different examples of sound absorbing materials are fiberglass, rockwool, wood or sound absorptive foam. A protective covering 16 like a wire-mesh cage or basket with approximately 95% or more open space is provided to cover the wedge unit. While the covering 16 may somewhat protect the sound absorbing wedges from minor impacts, the wire mesh design cannot effectively protect the material 12 from substantial physical impacts or exposure to oil-spills, dirt and other industrial deposits.

Figure 2A:
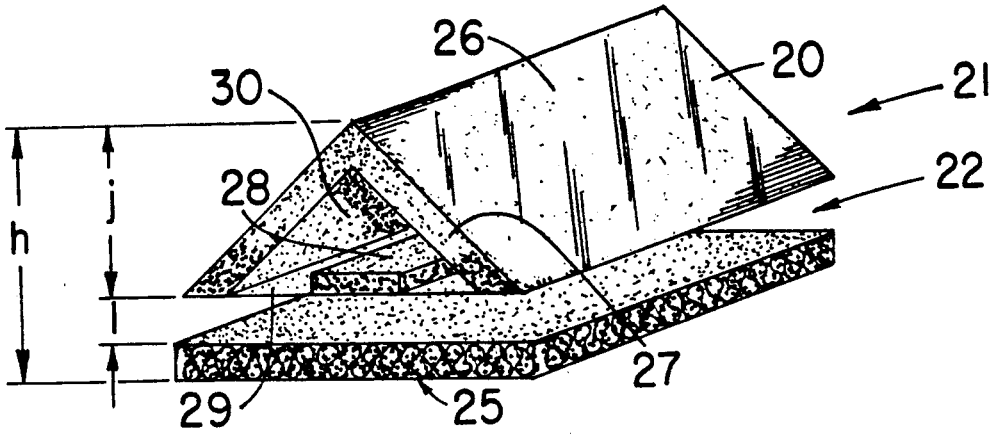
FIGS. 2A and 2B illustrate cross-sections of two embodiments of an anechoic wedge according to the present invention.

FIG. 2A illustrates the cross-section of a preferred embodiment according to the invention. Anechoic element 21 includes a generally flat panel 25 formed from sound absorbing material. The flat panel is first mounted against the anechoic chamber surfaces like the walls and the ceiling. Thereafter an anechoic wedge element 21 is disposed adjacent to the first panel 25, there preferably being an airspace 22 in between the first panel 25 and the anechoic wedge element 21. As illustrated, anechoic wedge element 21 is generally triangular in cross-section having a base member 29 and a pair of inclined wall members 26. The inclined wall members and the base member may have curved surfaces. Base member 29, which is preferably disposed in parallel to panel 25 is sound transmissive. Preferably, base 29 is made from a perforated metal sheet having an open area in the range of about 7% to 50% of the entire surface area of the base.

Wall members 26 each include a layer of sound absorptive material 27 and a cover sheet 20. As illustrated, each cover sheet 20 is made from a rigid protective material which enables substantial transmission of sound energy to the sound absorptive material. Cover sheet 20 may be formed from a perforated, sound reflective material such as metal. The open area of the cover sheet 20 may be as low as about 7% and may vary depending upon desired acoustical and physical characteristics. For instance, in certain applications where only very low frequencies are of interest, the open area ratio may be less than 7%.

As illustrated in FIG. 2A, anechoic wedge element 21 is generally hollow having a free space 30. However, as further shown in FIG. 2A, a layer of sound absorptive material 28 may be disposed on base member 29. As shown, sound absorptive layer 28 may be generally rectangular in cross-section having a width less than that of base member 29. Thus, there is airspace between layer 28 and the end portions of each wall 26 adjacent to base member 29. The size of layer 28 may vary depending upon the particular application. Thus, the entire surface of base member 29 may be covered with a layer of sound absorptive material. The height of the sound absorptive layer may be increased to decrease the interior airspace of wedge 21 and, thus, tune the device as desired.

In accordance with the invention, it is contemplated that a first panel 25 be laid along all the walls and ceiling of a room. Then a series of anechoic wedge elements 21 are disposed adjacent to each panel 25 with base members 29 being disposed generally parallel with panel 25 and with the apex of each of the anechoic wedge elements 21 pointing towards the interior of the room. The anechoic wedge elements may be held spaced apart from panel 25 by a supporting system disposed at the ends of the panel.

For deriving approximately similar results as from the conventional anechoic wedge depicted in FIG. 1, the anechoic wedge according to the invention as illustrated in FIG. 2A may have a height j=2", an airspace 1=8" and a sound absorptive layer thickness p=12". Therefore, the overall depth h of the anechoic wedge is approximately 40 inches. The open area of perforated cover sheets may be 23% having perforations 3/32" in diameter on 3/16" centers. A larger number of alternative configurations, such as different sizes for airspace 22, absorptive layer 24, absorptive layers 28 and 27, are possible to provide the same cut-off frequency. The cut-off frequency of the structure as illustrated in FIG. 2A and explained hereinabove is approximately 60 Hz.

Figure 2B:
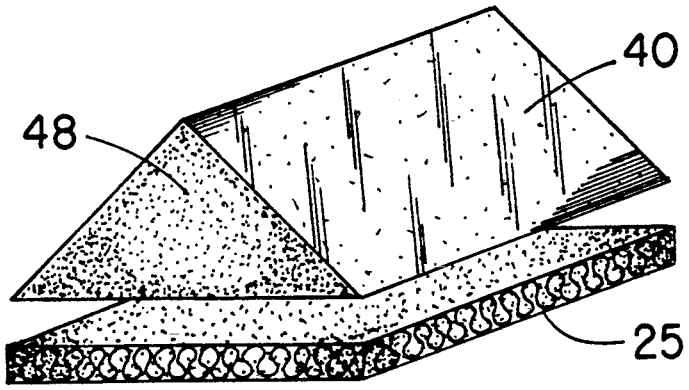

FIG. 2B illustrates another embodiment of the present invention. The anechoic wedge depicted in FIG. 2B has substantially similar characteristics to that of FIG. 2A. However, the sound absorbing material 48 fills substantially the entire space within the triangular wedge. Perforated cover sheets 40, similar to cover sheets 20, overlay sound absorptive material 28.

Figure 2C:
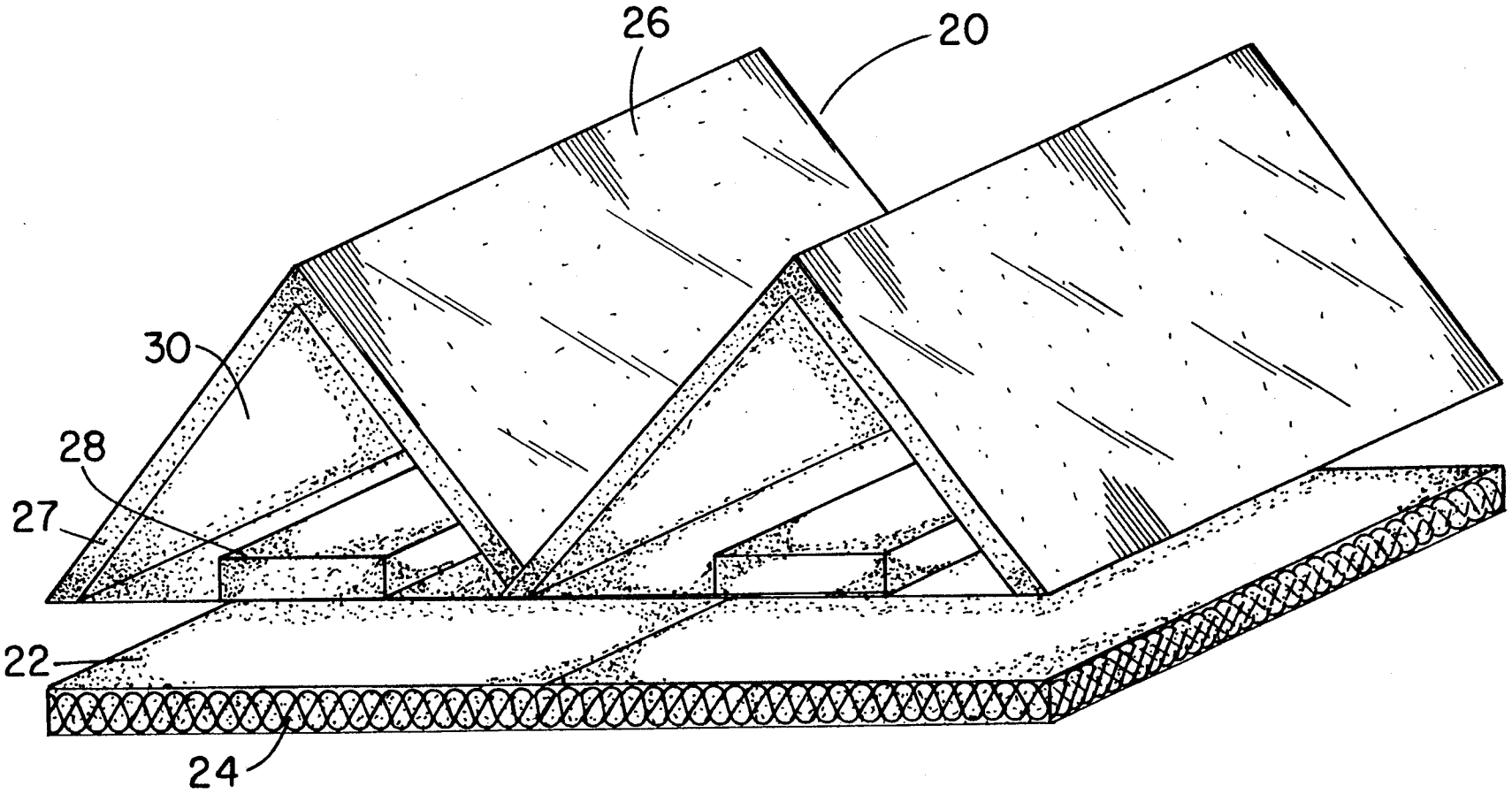
FIG. 2C illustrates a cross-section of a pair of anechoic wedges according to the present invention.

FIG. 2C illustrates a pair of anechoic wedges of FIG. 2A disposed next to each other. In a typical anechoic chamber a plurality of anechoic wedges are placed next to each other to form a panel for constructing a wall, a ceiling or a floor member.

For a complete anechoic chamber all chamber surfaces like walls, floor and ceiling may be covered by the structures as shown in FIGS. 2A–2C. Depending on the airspace and different dimensions of the absorptive layers, different frequency characteristics may result. In certain applications it is contemplated that there may be no airspace between flat panels 24 and 44 and wedge elements 21 and 40, respectively.

Figure 3A:
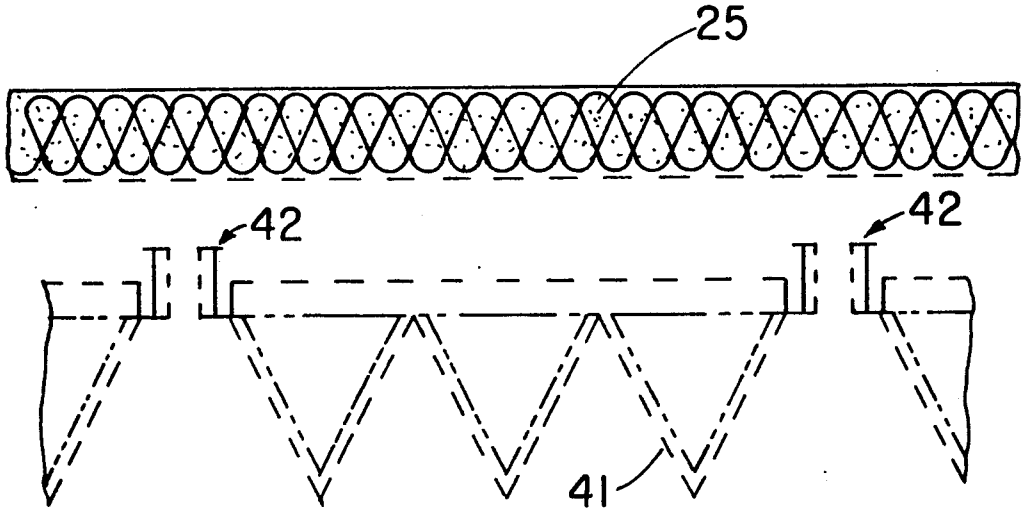
FIG. 3A illustrates a panel formed from a plurality of the wedge elements of FIG. 2B.
Figure 3B:
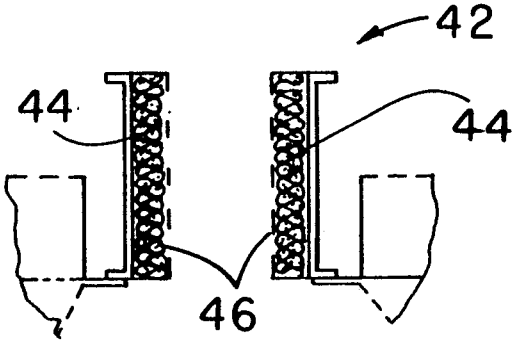
FIG. 3B illustrates an expanded view of a portion of FIG. 3A having an air flow duct.

FIG. 3A illustrates a plurality of anechoic wedges 41 of FIG. 2B disposed next to each other to form a panel. As shown, it is contemplated that an air flow duct 42 be disposed between wedges such that air may flow between flat panel 25 and wedge panel, through duct 42 and into the anechoic chamber. Referring to FIG. 3B, the air flow duct includes a pair of spaced apart layers of sound absorptive material 44, with an airspace therebetween. A perforated cover sheet 46 may be disposed over each layer of sound absorptive material. Thus, a quiet airflow system may be provided.

Figure 4:
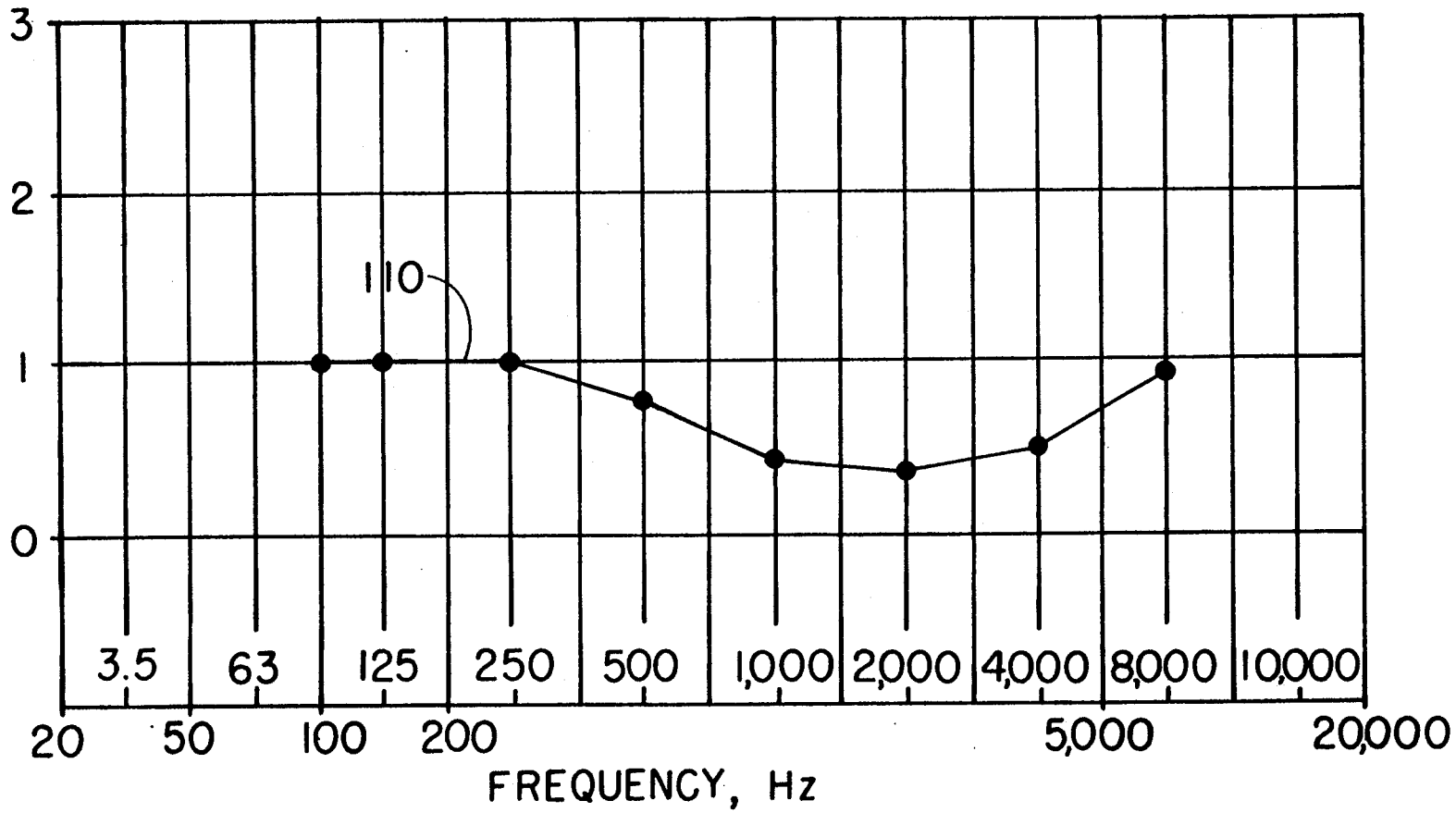
FIG. 4 illustrates graphically the deviations from inverse square law characteristics for two acoustic chambers equipped with wedge elements of FIG. 2A.

FIG. 4 illustrates a graph 110 of the deviations from the inverse square law for an anechoic room constructed in accordance with the wedge configurations illustrated in FIG. 2A. The wedge in FIG. 2A comprises perforated metal protected facings with dimensions, H=40 inches, J=20 inches, airspace L=8 inches and the sound absorptive layer P=12 inches. It will be noted that the 40-inch deep perforated wedge design of FIG. 2 provides deviations less than 1 dB from the inverse square law.

Figure 5A:
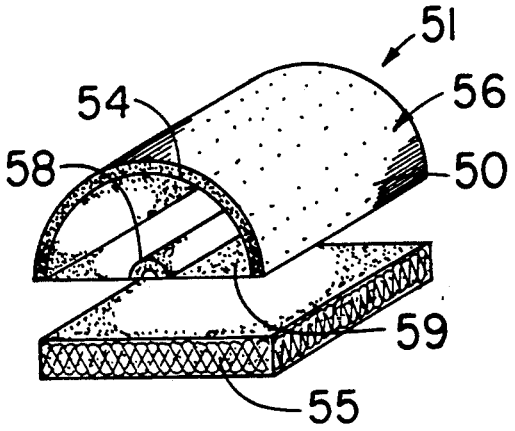
FIGS. 5A–5D illustrate various cross-sections of anechoic structures according to this invention.

FIGS. 5A–5D illustrate various cross-sections of other anechoic elements according to the invention. FIG. 5A shows a flat panel 55 formed of sound absorptive material disposed adjacent to an anechoic element 51 having a base 59 and semi-circular wall member 56. In accordance with the invention, wall member 56 includes a layer of sound absorptive material 54 and a cover sheet 50. In addition, base 59 and cover sheet 50 may be formed from a rigid perforated material such a metal, wood or plastic having an open area in the range of about 7% to 50%, preferably 23%, of the entire area of the respective base and wall member. Also in accordance with the invention, anechoic element 51 may be substantially hollow, having a layer of sound absorptive material 58 disposed on base 59. The size of layer 58 may be varied according to the application such that the entire space between wall 56 and base 59 may be filled with sound absorptive material.

Figure 5B:
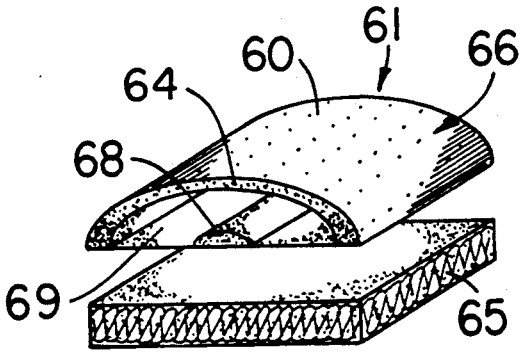

Similarly, FIG. 5B shows a substantially flat panel 65 formed of sound absorptive material disposed adjacent to an anechoic element 61 having a base 69 and a wall member 66 having a profile like an arc of a circle. Wall member 66 includes a layer of sound absorptive material 64 and a cover sheet 60. Base 69 and cover sheet 60 may be formed from a rigid perforated material such as metal, wood or plastic having an open area in the range of about 7% to 50%, preferably about 23%, of the entire area of the respective base and wall member. Also in accordance with the invention, anechoic element 61 may be substantially hollow, having a layer of sound absorptive material 68 disposed on base 69. The size of layer 68 may be varied according to the application such that the entire space between wall 66 and base 69 may be filled with sound absorptive material.

Figure 5C:
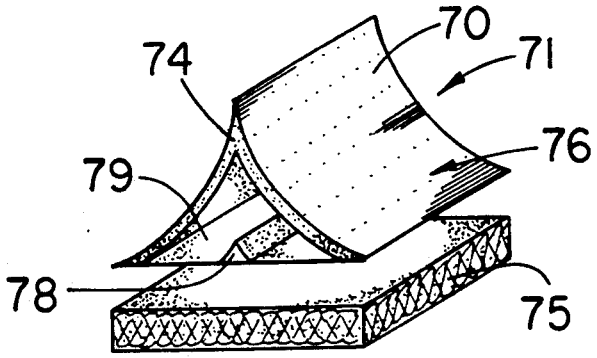

FIG. 5C shows a substantially flat panel member 75 formed of sound absorptive material disposed adjacent to an anechoic element 71 having a base 79 and an exponentially tapered wall member 76. Wall member 76 includes a layer of sound absorptive material 74 and a cover sheet 70. Base 79 and cover sheet 70 may be formed from a rigid perforated material such as metal, wood or plastic having an open area in the range of about 7% to 50%, preferably about 23%, of the entire area of the respective base and wall member. Also in accordance with the invention, anechoic element 71 may be substantially hollow, having a layer of sound absorptive material 78 disposed on base 79. The size of layer 78 may be varied according to the application such that the entire space between wall 76 and base 79 may be filled with sound absorptive material.

Figure 5D:
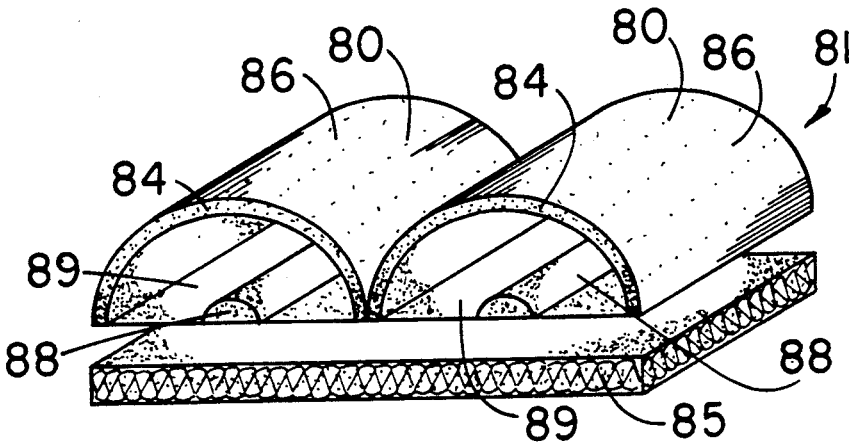

FIG. 5D shows a substantially flat panel member 85 formed of sound absorptive material disposed adjacent to an anechoic element 81 which has a corrugated profile member 86. Corrugated profile member 86 includes a layer of sound absorptive material 84 and a cover sheet 80. Base 89 and cover sheet 80 may be formed from a rigid perforated material such as metal, wood or plastic having an open area in the range of about 7% to 50%, preferably about 23%, of the entire area of the respective base and wall member. Also in accordance with the invention, anechoic element 81 may be substantially hollow, having a layer of sound absorptive material 88 disposed on base 89. The size of layer 88 may be varied according to the application such that the entire space between wall 86 and base 89 may be filled with sound absorptive material.

It can be appreciated by those skilled in the art that anechoic chambers according to the present invention may also be used for under water testing. Thus, the entire anechoic chamber can be utilized in water and the airspace provided in the embodiments described before may be filled with water. Additionally, fiberglass may be used as sound absorptive material. As a result, a free field environment may be created under water for various sound testings in a laboratory setting providing convenience and efficiency.

The above basic embodiments of the invention, and variations thereof, allow for economic trade-offs in anechoic chamber construction, depending on accuracies required in acoustic measurements as well as space availability and utilization considerations.

Significantly, however, the subject invention provides anechoic elements which, while providing the high degree of sound absorption required, also may be fully enclosed in a rigid protective covering. Contrary to the conventional wisdom in the art that anechoic elements had to be formed from fully or substantially fully exposed sound absorptive material, the subject invention provides anechoic elements which are substantially enclosed within protective metal coverings having preferably a mere 23% open area but also having as low as a 7% open area. And the protected anechoic elements of the invention provide substantially the same high degree of sound absorption and isolation provided by conventional unprotected devices.

As indicated hereinabove the perforated covering for the sound absorbing units provide protection against impact, erosion and dirt accumulation. Additionally, the space provided in between the panels allows for less use of absorbing material.

The foregoing description shows only preferred embodiments of the present invention. The invention in its broader aspects therefore is not limited to the specific embodiments herein show and described but departures may be made therefrom within the scope of the accompanying claims without departing from the principles of the invention and without sacrificing its chief advantages.

We claim:

1. A substantially enclosed sound absorbing unit for an anechoic chamber which provides a maximum deviation from the inverse square law of about 3 dB comprising:

a substantially flat panel member having a layer of sound absorptive material;

an anechoic member disposed adjacent to said flat panel member said anechoic member having a base and a pair of generally spaced apart sound transparent wall members, said wall members including a layer of sound absorptive material, said wall members further including a substantially solid, sound reflective, protective cover sheet thereover having perforations formed therein, said perforations forming a free space and in which said free space of said perforated cover sheet is at least about 7% of the total area of the cover sheet.

2. A sound absorbing unit according to claim 1 wherein said anechoic member is spaced from said panel member.

3. The sound absorbing unit according to claim 1, wherein said anechoic member has a substantially semicircular cross-section.

4. The sound absorbing unit according to claim 1, wherein said anechoic member has a substantially arcuate cross-section.

5. The sound absorbing unit according to claim 1, wherein said anechoic member has a substantially exponentially tapered cross-section.

6. The sound absorbing unit according to claim 1, wherein said anechoic member has substantially a corrugated cross-section.

7. A sound absorbing unit according to claim 2 wherein said space between said flat panel member and said anechoic member is adapted to be filled with water.

8. The sound absorbing unit according to claim 1, wherein said anechoic member has a substantially triangular cross-section.

9. The sound absorbing unit according to claim 8, wherein said anechoic member is substantially hollow, including an inside layer of sound absorptive material disposed on said base.

10. The sound absorbing unit according to claim 9, wherein said inside layer of sound absorptive material has a substantially rectangular cross-section.

11. The sound absorbing unit according to claim 8, wherein said sound reflective material is metal.

12. The sound absorbing unit according to claim 8, wherein said sound reflective material is plastic.

13. The sound absorbing unit according to claim 8, wherein said sound reflective material is wood.

14. An assembly for forming a wall or ceiling in an anechoic chamber which provides a maximum deviation from the inverse square law of about 3 dB comprising:

a first substantially flat panel member formed from a sound absorptive material; and an anechoic wedge panel spaced apart from said first panel member, said wedge panel including a plurality of wedge members each of which is generally triangular in cross-section, each wedge member having a base member and a pair of inclined wall members, each of said base members being formed from an integral perforated metal sheet, said perforations forming a free area, said base members and said wedge members being integral with one another so that said bases form a support panel generally parallel to and spaced apart from said first panel member, each of said wedge wall members including a layer of sound absorptive material and a substantially solid, sound reflective, protective perforated metal cover sheet, said perforations forming a free area, said free areas of said perforated base members and said cover sheets being in the range of about 7% to 50% of the entire area of each respective base member and cover sheet.

15. An assembly as in claim 14, wherein each wedge member is hollow and includes a layer of sound absorptive material disposed on its respective base member in the interior of said wedge member.

16. An assembly as in claim 14 wherein said perforated base members and cover sheets free areas are in the range of about 7% to 30% of the entire area of each respective base member and cover sheet.

17. An assembly as in claim 16 wherein said perforated base members and cover sheets free space are in the range of about 23% of the entire area of each respective base member and cover sheet.

18. An assembly according to claim 14 wherein said wedge panel includes an air flow duct for providing a flow path between the space between said first panel and said wedge panel, said air flow duct having a pair of spaced apart side wall, each side wall being formed from sound absorptive material.

19. A substantially enclosed sound absorbing unit for an anechoic chamber which provides a maximum deviation from the inverse square law of about 3 dB comprising:

a substantially flat panel member having a layer of sound absorptive material;

an anechoic member disposed adjacent to said flat panel member said anechoic member having a base and a pair of generally spaced apart sound transparent wall members, said wall members including a layer of sound absorptive material, said wall members further including in integral cover sheet thereover made of perforated, substantially sound reflective material, said perforations forming a free space therein and in which said free space of said perforated cover sheet is at least about 7% of the total area of the cover sheet, wherein said anechoic member has a substantially triangular cross-section, said anechoic member being substantially hollow, including an inside layer of sound absorptive material disposed on said base, in which said inside layer of sound absorptive material has a substantially rectangular cross-section in which the width of said rectangular cross-section is smaller than the width of said base.

20. The sound absorbing unit according to claim 19 further comprising sound absorptive material within said anechoic member hollow.

21. The sound absorbing unit according to claim 19, wherein the height of said inside layer of sound absorption material is equal to or smaller than the height of said anechoic member triangular cross-section.

22. The sound absorbing unit according to claim 21, wherein said base of said anechoic member is made from a perforated substantially sound reflective material, said perforations forming a free area in the range of approximately 7% to 50% of the entire area of the base.

23. The sound absorbing unit according to claim 22, wherein said anechoic member triangular cross-section is substantially filled with sound absorptive material.

* * * * *

UNITED STATES PATENT AND TRADEMARK OFFICE

CERTIFICATE OF CORRECTION

PATENT NO. : 5,317,113

DATED : May 31, 1994

INVENTOR(S) : John Duda

It is certified that error appears in the above-indentified patent and that said Letters Patent is hereby corrected as shown below:

Column 9, Claim 18, line 2, delete "wall" and substitute -- walls --.

Signed and Sealed this

Twenty-seventh Day of September, 1994

*Attest:*

Bruce Lehman

BRUCE LEHMAN

*Attesting Officer*

*Commissioner of Patents and Trademarks*